US009908743B2

(12) United States Patent
Herkel

(10) Patent No.: US 9,908,743 B2
(45) Date of Patent: Mar. 6, 2018

(54) ADAPTIVE POWER CONTROL FOR ELEVATOR SYSTEM USING POWER PROFILES

(75) Inventor: Peter Herkel, Berlin (DE)

(73) Assignee: OTIS ELEVATOR COMPANY, Farmington, CT (US)

( * ) Notice: Subject to any disclaimer, the term of this patent is extended or adjusted under 35 U.S.C. 154(b) by 561 days.

(21) Appl. No.: 14/402,373

(22) PCT Filed: May 24, 2012

(86) PCT No.: PCT/US2012/039264

§ 371 (c)(1),
(2), (4) Date: Nov. 20, 2014

(87) PCT Pub. No.: WO2013/176670

PCT Pub. Date: Nov. 28, 2013

(65) Prior Publication Data

US 2015/0144434 A1 May 28, 2015

(51) Int. Cl.
*B66B 1/06* (2006.01)
*B66B 1/34* (2006.01)
*B66B 1/30* (2006.01)

(52) U.S. Cl.
CPC ..... *B66B 1/3407* (2013.01); *B66B 1/302* (2013.01)

(58) Field of Classification Search
CPC ..... B66B 1/3407; B66B 1/302
USPC ..... 187/247, 289, 290, 293, 295, 296, 297, 187/391, 393
See application file for complete search history.

(56) References Cited

U.S. PATENT DOCUMENTS 6,243,548 B1 6/2001 Hebert et al.
6,681,899 B1 * 1/2004 Hong ..... B66B 3/02 187/391
7,755,223 B2 * 7/2010 Fitzgibbon ..... E05F 15/603 187/317
7,866,446 B2 1/2011 Lindegger
7,942,246 B2 * 5/2011 Saarikoski ..... B66B 1/34 187/290

(Continued)

FOREIGN PATENT DOCUMENTS

JP H07247061 A 9/1995
JP 2009091099 A 4/2009
WO 2009154618 A1 12/2009

OTHER PUBLICATIONS

European Search Report for application EP 12877130.0 , dated Jun. 6, 2015, 5 pages.

(Continued)

*Primary Examiner* — Anthony Salata
(74) *Attorney, Agent, or Firm* — Cantor Colburn LLP

(57) ABSTRACT

A system for managing power in an elevator system, the system including an elevator controller; an elevator car in communication with the controller; a component associated with the elevator car; a power management system in communication with the controller; and a database in communication with the power management system, the database including a power profile; wherein the power management system provides power commands to the elevator controller to enter a power savings mode in response to the power profile, the controller sending a power off signal to the component in response to the power command.

30 Claims, 3 Drawing Sheets

(56) References Cited

U.S. PATENT DOCUMENTS

| | | | | |
|---|---|---|---|---|
| 8,528,701 | B2 * | 9/2013 | Schwarzentruber | B66B 1/468 187/384 |
| 8,662,257 | B2 * | 3/2014 | Chasteen | B66B 1/34 187/316 |
| 8,794,390 | B2 * | 8/2014 | Chasteen | B66B 11/0233 187/316 |
| 8,869,947 | B2 * | 10/2014 | Harkonen | G09F 21/00 187/295 |
| 9,016,440 | B2 * | 4/2015 | Finschi | B66B 1/2458 187/382 |
| 9,212,030 | B2 * | 12/2015 | Finschi | B66B 25/00 |
| 9,327,940 | B2 * | 5/2016 | Hanninen | B66B 1/2491 |
| 9,376,289 | B2 * | 6/2016 | Herkel | B66B 1/14 |
| 9,440,819 | B2 * | 9/2016 | Rossignol | B66B 1/302 |
| 2005/0273638 | A1 | 12/2005 | Kaiju et al. | |
| 2007/0295566 | A1 | 12/2007 | Lindegger | |
| 2010/0258383 | A1 | 10/2010 | Saarikoski et al. | |
| 2012/0212323 | A1 | 8/2012 | Skaaksrud et al. | |

OTHER PUBLICATIONS

Extended European Search Report for application EP 14182197.5, dated Feb. 5, 2015, 22 pages.

Lopez de Ipina, Diego, et al., "TRIP: A low-cost vision-based location system for ubiquitous computing", Personal and Ubiquitous Computing, May 1, 2002, pp. 206-219.

International Search Report for application PCT/US2012/039264, dated Feb. 26, 2013, 5 pages.

Written Opinion for application PCT/US2012/039264, dated Feb. 26, 2013, 3 pages.

* cited by examiner

| 200 Profile ID | 202 Time | 204 Components OFF | 206 Power Savings | 208 Reactivation Time | 210 Threshold | 212 Active |
|---|---|---|---|---|---|---|
| Profile 1 | M-F; 10PM-4AM | Light; fixtures; PRS; door drive; drive | 135 W | 6 seconds | 4 calls/hour | y |
| Profile 2 | M-F; 10AM-3PM | Light; fixtures; PRS | 95 W | 2 seconds | 4 calls/hour | n |
| Profile 3 | M-F; 10PM-4AM | a) Light & fixtures, 4 min with no call;<br>b) a + PRS, drive 10 min with no call;<br>c) b + door drive, 30 min with no call | a) 50%<br>b) 70%<br>c) 90% | a) 2 seconds<br>b) 10 seconds<br>c) 20 seconds | 2 calls/hour | n |
| Custom Profile 1 | F; 6PM-9PM | Light; fixtures; PRS; door drive; drive | 135 W | 6 seconds | 4 calls/hour | y |

FIG. 2

ADAPTIVE POWER CONTROL FOR ELEVATOR SYSTEM USING POWER PROFILES

BACKGROUND OF THE INVENTION

Embodiments relate generally to elevator systems, and more particularly, to adaptive power control for elevator systems.

Power savings are desirable in practically all electrically powered systems, including elevator systems. Existing elevator power savings systems are rather inflexible; they are either active or inactive at any given time. These systems typically involve switching off parts of an elevator system's electrical system. Each of these parts has a reactivation time to transition from a powered off state to a powered on state. In elevator systems, parts are reactivated to answer an elevator car call, for example. Existing power savings systems do not balance power saving and reactivation time in an efficient manner.

SUMMARY OF THE INVENTION

An exemplary embodiment is a system for managing power in an elevator system, the system including an elevator controller; an elevator car in communication with the controller; a component associated with the elevator car; a power management system in communication with the controller; and a database in communication with the power management system, the database including a power profile; wherein the power management system provides power commands to the elevator controller to enter a power savings mode in response to the power profile, the controller sending a power off signal to the component in response to the power command.

Another exemplary embodiment is a method for managing power in an elevator system, the method including storing a custom power profile, the custom power profile identifying a component to be turned off during a power savings mode; determining a time; determining if the custom power profile is to be applied in response to the time; sending a power command to an elevator controller in response to the component identified in the custom power profile; and sending a power off signal to the component in response to the power command.

BRIEF DESCRIPTION OF THE DRAWINGS

The subject matter, which is regarded as the invention, is particularly pointed out and distinctly claimed in the claims at the conclusion of the specification. The foregoing and other features and advantages of the invention are apparent from the following detailed description, taken in conjunction with the accompanying drawings, in which:

FIG. 2 depicts power profiles according to an exemplary embodiment of the invention.

The detailed description of the invention describes exemplary embodiments of the invention, together with some of the advantages and features thereof, by way of example with reference to the drawings.

DETAILED DESCRIPTION OF THE INVENTION

Figure 1:
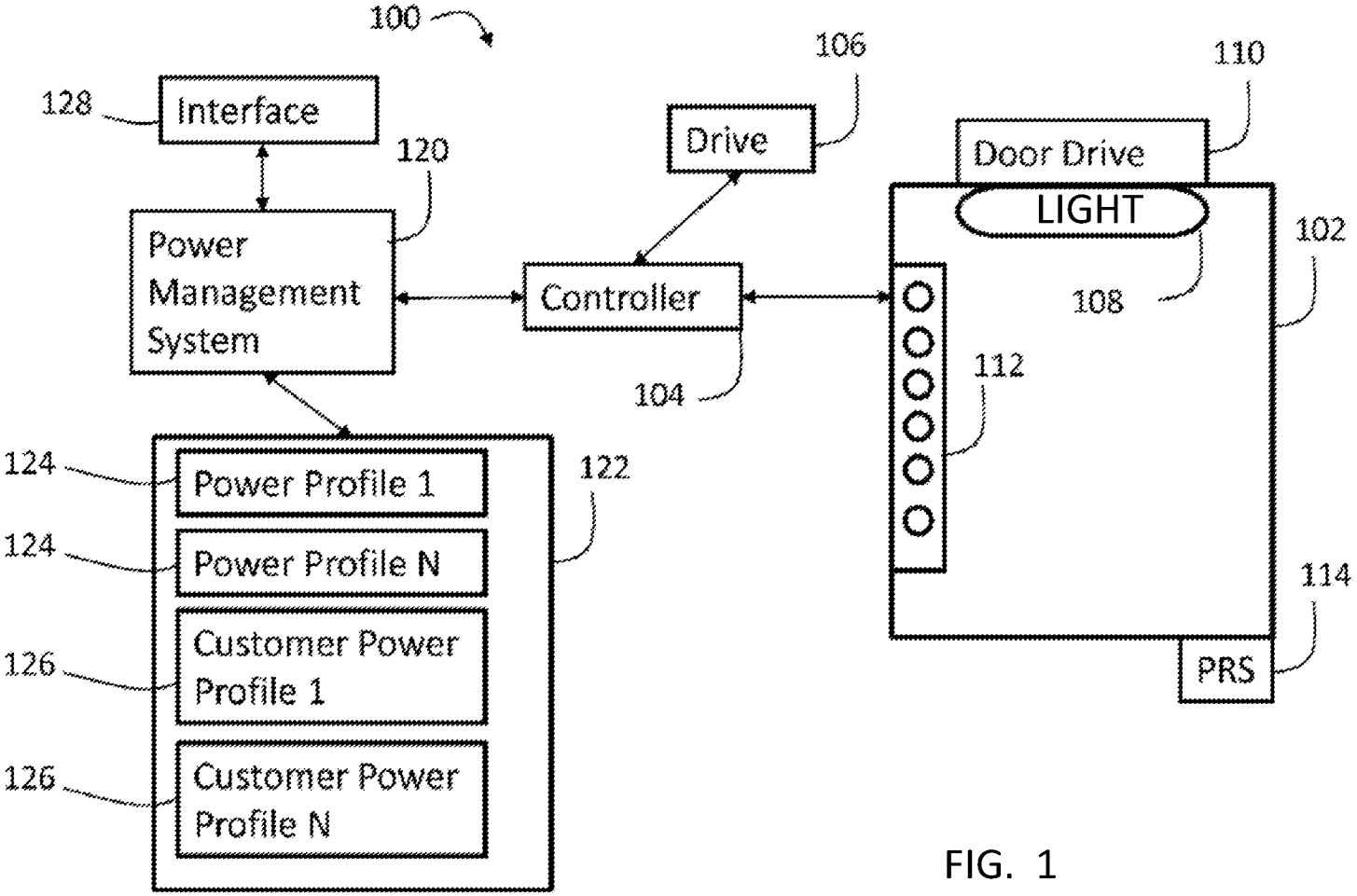
FIG. 1 illustrates an elevator system according to an exemplary embodiment of the invention.

FIG. 1 illustrates an elevator system 100 according to an exemplary embodiment of the invention. Elevator system

100 includes an elevator car 102 in communication with a controller 104. Controller 104 may be an existing elevator controller that receives destination calls from elevator car 102. Controller 104 issues commands to a drive 106 to move elevator car 102 to the proper floor. Drive 106 may include an electric motor that moves elevator car 102 through a traction sheave and belt (not shown). Controller 104 controls the powered state (e.g., on or off) of components of elevator car 102 and the drive 106 as described in further detail herein. Only a single elevator car 102 is depicted in FIG. 1 for ease of illustration. It is understood that controller 104 may control a plurality of elevator cars.

Elevator car 102 includes a number of electrically powered components that may be controlled through power-on and power-off signals from controller 104. A car light 108 provides interior lighting for the elevator car 102. A door drive 110 includes an electric motor and is used to open and close elevator doors when elevator car 102 is at a landing. An elevator car fixture 112 may include destination inputs in the form of buttons or a touchscreen. A position reference system 114 travels with elevator car 102 and includes sensors to determine when the elevator car 102 is positioned properly with respect to a landing. It is understood that elevators car 102 may include a number of other components.

A power management system 120 is in communication with controller 104. Power management system 120 may be implemented by a general-purpose computer executing a program stored in a storage medium to perform the processes described herein. Alternatively, power management system 120 may be implemented as part of controller 104, as a standalone component, or as a combination of the two. Power management system 120 accesses a database 122 to store and retrieve power profiles. Database 122 may be internal to power management system 120 or accessed over a network. An interface 128 is provided to the power management system 120 to allow a user to activate one or more power profiles and generate custom power profiles. The user interface 128 may be remotely located from the power management system 120 and access the power management system 120 over a network. For example, user interface 128 may use a web browser to access the power management system 120 over the Internet. User access to the power management system 120 may be controlled through the use of passwords, etc.

Database 122 stores power profiles that indicate which components of the elevator system are to be powered off, and at what times, in order to provide power savings. The power profiles may include pre-established power profiles 124 and custom power profiles 126. FIG. 2 depicts exemplary power profiles stored in database 122. Each power profile includes a profile identifier field 200 that identifies the power profile. Field 202 indicates a time (e.g., day of week and/or time of day) during which the power profile is to be applied. Field 204 identifies which components of the elevator system are to be shut off. Field 206 indicates a power savings for the power profile.

Field 204 may include a graded power profile based on the occurrence or lack of occurrence of certain events. For example, power profile 3 in FIG. 2 shows an exemplary graded power profile that increases power savings with decreasing activity in the elevator system. As shown in power profile 3, if there is no elevator call for a first time period (e.g., 4 minutes) then first components (e.g., car light and car fixtures) are shut off. After a second time period (e.g., 10 minutes) with no elevator call, then second components (e.g., position reference system and drive) are shut off, in addition to the first components. After a third time period (e.g., 30 minutes) with no elevator call, then third components (e.g., door drive) are shut off, in addition to the first and second components. In this manner, a single profile may be selected that includes graded power savings.

Field 208 indicates a reactivation time to transition from the power savings mode implemented by the power profile to a standard operational mode, where all components of the elevator system are powered. The reactivation time represents the time needed to power the components back on after being powered off in the power savings mode. The reactivation time is helpful in selecting a power profile, as wait times for an elevator can be a source of dissatisfaction with elevator users. During periods of high elevator usage, a power profile having a low reactivation time should be used, if any power savings mode is applied at all.

Field 210 identifies a threshold of activity that will cause the power management system 120 to exit power savings mode and enter standard operational mode. The threshold in FIG. 2 is expressed as a number of elevator calls per unit time. It is understood that other units may be used for the threshold (e.g., a total number of elevator calls, etc.). Field 212 indicates whether the profile is active, i.e., if the profile will be applied during the corresponding time. Field 212 allows a user to select one or more power profiles to be applied at different times.

Database 122 includes pre-established power profiles 124 and custom power profiles 126. The pre-established power profiles 124 may be provided by the supplier of the power management system 120 and correspond to expected traffic patterns for elevator system 100 in typical installations. The pre-established power profiles 124 may be designed for pre-defined types of installations, e.g. office building, residential, hotel, low-rise, mid-rise, hi-rise, etc.

Custom power profiles 126 may be generated in multiple ways. An authorized user may access power management system 120 through user interface 128 and program a custom power profile 126 manually. This may include the user designating the times for field 202, the components to be turned off for field 204, the threshold for field 210 and whether the profile is active in field 212. The power management system 120 may automatically compute the power savings for field 206 and the reactivation time for field 208 based on the components to be turned off. Based on the computed power savings and reactivation time, the user may modify the components to be turned off.

A custom power profile 126 may also be generated based on a user's designation of a desired level of power savings. That is, a user may specify a desired power savings specifically (95 W, 110 W, etc.) or generally (25%, 50%, 67%, etc.), and based on the specified level, the power management system 120 may generate a custom power profile 126. It is understood, that the power management system 120 may also allow a user to designate components that should or should not be used by the power management system 120 to achieve the desired power savings. The power management system 120 may also generate custom power profiles 126 based on a specified maximum reactivation time. It is further understood, that the power management system 120 may be configured to generate custom power profiles 126 based on any of these or other criteria alone or in combination.

A custom power profile 126 may also be generated through an adaptive learning process executed by the power management system 120. The power management system 120 may monitor elevator system usage over a period of time (e.g., two weeks) and record usage based on time of day and day of week. Based on the amount of usage, the power management system 120 determines a custom power profile 126. In general, the custom power profile 126 will shut off more components (and have a higher reactivation time) during periods of lower expected elevator usage and shut off fewer components (and have a lower reactivation time) during periods of higher expected elevator usage. A custom power profile 126 may continuously adapt to usage of the elevator system 100, to account for changes in elevator usage patterns (e.g., seasonal changes, daylight savings time, etc.).

While FIG. 2 depicts separate profiles for distinct time periods, it is understood that more complex profiles may be used. That is, a single profile may indicate different components off, power savings, reactivation time, and threshold values for different times of day, different days of the week, etc. Furthermore, override profiles may be implemented to allow a user to override the active profiles for a discrete period of time. For example, if a user became aware of a conference being scheduled for a particular day, the user could create an override profile for that day that would prevent certain power saving modes from being implemented for that day, or for particular time throughout the day according to the meeting's agenda. This allows for a user to customize a power management system 120 for a specific time or event without having to alter the normal configuration of the system. Further, the power management system may include a calendar to assist users in creating override profiles. Additionally, the calendar may be used to implement reoccurring override profiles. As an example, a user may wish to enter an override profile that implements maximum power savings during holidays when an office building may be closed, and when maximum reactivation times may be acceptable. Entering such reoccurring override profiles will alleviate the burden of entering duplicative override profiles every year.

Figure 3:
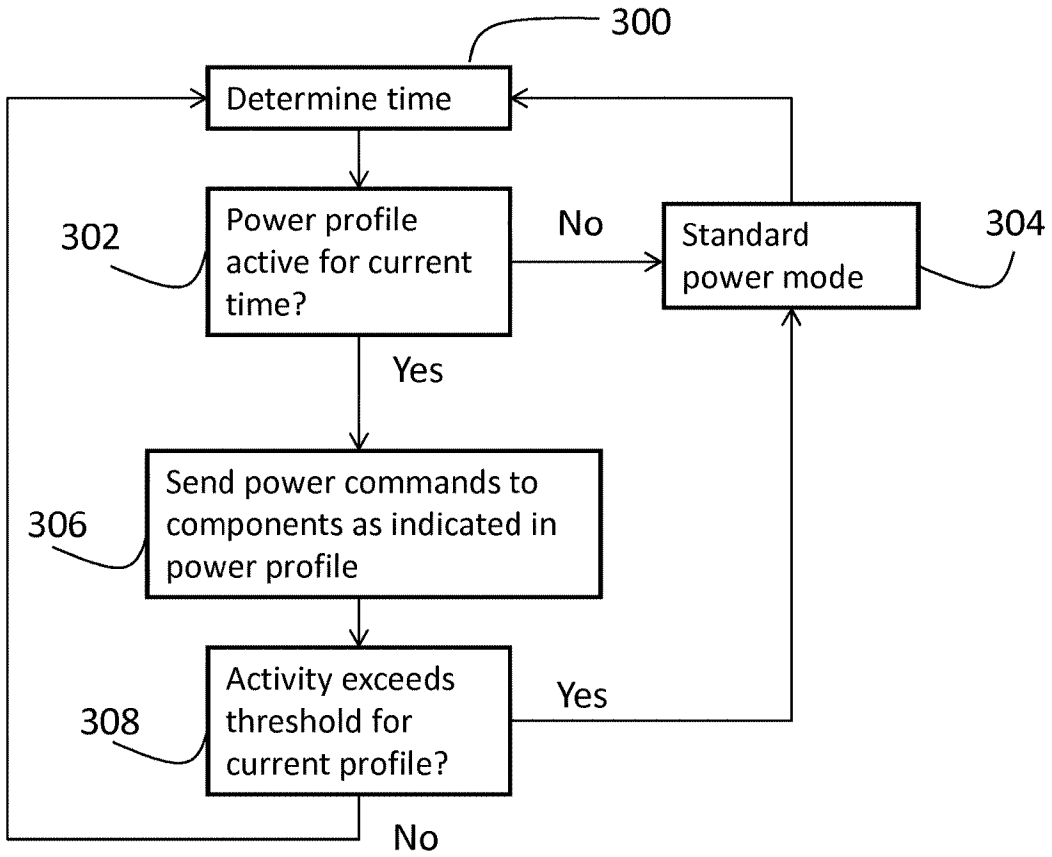
FIG. 3 is a flowchart of a process for controlling power savings in an exemplary embodiment of the invention.

FIG. 3 is a flowchart of an exemplary process for controlling power savings in elevator system 100. The process beings at 300 where the power management system 120 determines the current time, which may include the year, time of day, day of week and week of year. Based on the time, the power management system 120 determines if a power profile is active for the current time at 302. This is determined by examining field 202 and field 212 shown in FIG. 2. If there is a conflict such that two power profiles are active for the same time, the power management system 120 can select the power profile with the higher power savings or the power profile with the lower reactivation time, depending on a preset user preference. This decision may also be made based on a priority ranking assigned by a user.

If no power profile is active for the current time, flow proceeds to 304 where power management system 120 selects standard power mode. Standard power mode may be an operational mode where no components are shut off in an attempt to provide power savings. Alternatively, a user may set any other profile as a default profile to be used as a standard power mode. Controller 104 may issue a power on signal to components of the elevator system upon entering the standard power mode. This typically corresponds to periods of high usage of the elevator system 100, where reactivation times are to be avoided. Flow proceeds to 300 where process repeats.

If at 302 a power profile is active for the current time, flow proceeds to 306 where power management system 120 issues power commands to controller 104 to enter a power savings mode in response to the power profile. The power commands from power management system 120 indicate which components of the elevator system 100 are to be powered off. Controller 104 then issues a power off signal to the components identified by power management system 120.

At 308 power management system 120 determines if activity of the elevator system 100 exceeds a threshold associated with the power profile. Power management system 120 is in communication with controller 104 and detects elevator calls. If the elevator system activity exceeds the threshold, this indicates that the system should transition to standard power mode to avoid reactivation time delays. In this case, flow proceeds to 304. Otherwise, flow proceeds to 300 where the process repeats.

Embodiments provide adaptive control of power savings including a scaling of power savings and reactivation time. Several levels of power reduction are available, with each level defined by power reduction capability and reactivation time. The use of multiple power profiles enables a stepwise reduction of power consumption together with a stepwise increase of reactivation time. Custom power profiles can be adjusted by the user to balance between power savings and reactivation time. Custom power profiles may also be adaptively learned based on elevator system usage.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Where certain features have been described in conjunction with one embodiment of the invention, it is understood that these features may be used with alternative embodiments of the invention, whether described or understood. Accordingly, the invention is not to be seen as limited by the foregoing description, but is only limited by the scope of the appended claims.

The invention claimed is:

1. A system for managing power in an elevator system, the system comprising:

an elevator controller;

an elevator car in communication with the controller;

a component associated with the elevator car;

a power management system in communication with the controller; and a database in communication with the power management system, the database including a power profile; wherein the power management system provides power commands to the elevator controller to enter a power savings mode in response to the power profile, the controller sending a power off signal to the component in response to the power command;

the power profile provides graded power savings by identifying a first component to power off after a first time period and a second component to power off after a second time period, the second time period longer than the first time period.

2. The system of claim 1 wherein the power profile includes (i) times and/or days and (ii) components to be powered off during the times and/or days.

3. The system of claim 1 wherein: the power profile includes a pre-established profile.

4. The system of claim 1 wherein: the power profile includes a custom power profile produced by a user.

5. The system of claim 4 wherein: the custom power profile is generated in response to one or more of (i) a desired level of power savings, (ii) a designation of components that should or should not be powered off and (iii) a maximum reactivation time.

6. The system of claim 1 wherein:

the power profile includes a custom power profile, the power management system executing an adaptive learning process to produce the custom power profile.

7. The system of claim 6 wherein:

the adaptive learning process monitors elevator system usage over a period of time, records usage based on time of day and day of week and determines the custom power profile, the custom power profile shutting off more components during periods of lower expected elevator usage and shutting off fewer components during periods of higher expected elevator usage.

8. The system of claim 7 wherein:

the custom power profile is continuously adapted in response to usage of the elevator system.

9. The system of claim 1 wherein:

the power profile includes an override profile that prevents the power saving mode from being implemented for a time period.

10. The system of claim 9 further comprising:

a calendar for creating the override profile.

11. The system of claim 1 wherein:

the power profile includes a power savings field and a reactivation time field, the reactivation time field identifying a time to transition from a power savings mode to a standard power mode.

12. The system of claim 1 wherein:

the power profile includes an activity threshold; the power management system monitoring elevator system usage and exiting power savings mode if the elevator system usage exceeds the activity threshold.

13. The system of claim 12 wherein:

the activity threshold is a number of elevator calls per unit time.

14. The system of claim 12 wherein:

the activity threshold is a total number of elevator calls.

15. The system of claim 12 wherein:

the activity threshold is a time period.

16. The system of claim 1 wherein:

the component includes at least one of an elevator car light, an elevator car fixture, a position reference system and an elevator door drive.

17. The system of claim 1 wherein:

the component includes a drive for imparting motion to the elevator car.

18. A method for managing power in an elevator system, the method comprising:

storing a custom power profile, the custom power profile identifying a component to be turned off during a power savings mode;

determining a time;

determining if the custom power profile is to be applied in response to the time;

sending a power command to an elevator controller in response to the component identified in the custom power profile; and sending a power off signal to the component in response to the power command;

the power profile provides graded power savings by identifying a first component to power off after a first time period and a second component to power off after a second time period, the second time period longer than the first time period.

19. The method of claim 18 wherein the power profile includes (i) times and/or days and (ii) components to be powered off during the times and/or days.

20. The method of claim 18 wherein:

the custom power profile is generated through a user interface.

21. The method of claim 18 wherein:

the custom power profile includes a power savings field and a reactivation time field, the reactivation time field identifying a time to transition from the power savings mode to a standard power mode.

22. The method of claim 18 further comprising:

executing an adaptive learning process to generate the custom power profile.

23. The method of claim 22 wherein:

the adaptive learning process monitors elevator system usage over a period of time, records usage based on time of day and day of week and determines the custom power profile, the custom power profile shutting off more components during periods of lower expected elevator usage and shutting off fewer components during periods of higher expected elevator usage.

24. The method of claim 23 wherein:

the custom power profile is continuously adapted in response to usage of the elevator system.

25. The method of claim 18 wherein:

the custom power profile is generated in response to one or more of (i) a desired level of power savings, (ii) a designation of components that should or should not be powered off and (iii) a maximum reactivation time.

26. The method of claim 18 further comprising:

storing an override profile that prevents the power saving mode from being implemented for a time period.

27. The method of claim 18 further comprising:

monitoring elevator system usage and exiting the power savings mode if the elevator system usage exceeds an activity threshold in the power profile.

28. The method of claim 27 wherein:

the activity threshold is one of a number of elevator calls per unit time and a total number of elevator calls.

29. The method of claim 18 wherein:

the component includes at least one of an elevator car light, an elevator car fixture, a position reference system and an elevator door drive.

30. The method of claim 18 wherein:

the component includes a drive for imparting motion to the elevator car.

* * * * *